US012663194B2

(12) United States Patent
Park et al.

(10) Patent No.: US 12,663,194 B2
(45) Date of Patent: Jun. 23, 2026

(54) ICE MAKER AND CONTROL METHOD THEREFOR

(71) Applicant: SAMSUNG ELECTRONICS CO., LTD., Suwon-si (KR)

(72) Inventors: Chanyoung Park, Suwon-si (KR); Daesung Ki, Suwon-si (KR); Juyeong Kim, Suwon-si (KR); Hyunuk Park, Suwon-si (KR); Hyeonkyu Lim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 134 days.

(21) Appl. No.: 18/531,347

(22) Filed: Dec. 6, 2023

(65) Prior Publication Data

US 2024/0102714 A1 Mar. 28, 2024

Related U.S. Application Data

(63) Continuation of application No. PCT/KR2022/006877, filed on May 13, 2022.

(30) Foreign Application Priority Data

Jul. 5, 2021 (KR) ..... 10-2021-0088152

(51) Int. Cl.
*F25C 5/08* (2006.01)
*F25C 1/25* (2018.01)

(52) U.S. Cl.
CPC ..... *F25C 5/08* (2013.01); *F25C 1/25* (2018.01); *F25C 2600/04* (2013.01); *F25C 2700/12* (2013.01)

(58) Field of Classification Search
CPC ..... F25C 5/08; F25C 1/25; F25C 2600/04; F25C 2700/12; F25C 1/04; F25C 1/24
See application file for complete search history.

(56) References Cited

U.S. PATENT DOCUMENTS 9,080,800 B2 7/2015 Culley
10,508,852 B2 12/2019 Yang
(Continued)

FOREIGN PATENT DOCUMENTS

CN 106257216 A 12/2016
JP 2008-170086 A 7/2008
(Continued)

OTHER PUBLICATIONS

KR 100781261 B1 Translation (Year: 2007).*
(Continued)

*Primary Examiner* — Jerry-Daryl Fletcher
*Assistant Examiner* — Dario Antonio Deleon
(74) *Attorney, Agent, or Firm* — Sughrue Mion, PLLC

(57) ABSTRACT

An ice maker includes an ice-making container that includes a first tray and a second tray coupled to each other at a sealing surface between the first tray and the second tray. The ice maker may include a water supply guide including one end connected to the ice-making container, the water supply guide being configured to supply water to the ice-making container. The ice maker may include a first heater provided adjacent to or in the ice-making container; and a second heater provided adjacent to or in the ice-making container, and provided at a position that is different than a position of the first heater. The first heater may be provided closer to the sealing surface than the second heater.

20 Claims, 13 Drawing Sheets

(56) References Cited

U.S. PATENT DOCUMENTS

| | | | | |
|---|---|---|---|---|
| 10,605,512 | B2 | 3/2020 | Culley et al. | |
| 2014/0165618 | A1* | 6/2014 | Culley et al. | F25C 1/18 62/71 |
| 2015/0021458 | A1 | 1/2015 | Zorovich et al. | |
| 2016/0370063 | A1* | 12/2016 | Yang | F25C 1/25 |
| 2025/0155178 | A1* | 5/2025 | Son et al. | F25C 5/06 |

FOREIGN PATENT DOCUMENTS

| | | | | |
|---|---|---|---|---|
| KR | 10-0376164 | B1 | 3/2003 | |
| KR | 10-2006-0039094 | A | 5/2006 | |
| KR | 100781261 | B1 * | 11/2007 | F25C 1/24 |
| KR | 10-1643635 | B1 | 7/2016 | |
| KR | 10-2016-0149095 | A | 12/2016 | |
| KR | 10-1760814 | B1 | 7/2017 | |
| KR | 10-2021-0005478 | A | 1/2021 | |
| KR | 10-2021-0005479 | A | 1/2021 | |
| KR | 10-2021-0005488 | A | 1/2021 | |
| KR | 10-2021-0005798 | A | 1/2021 | |
| KR | 10-2021-0026644 | A | 3/2021 | |
| KR | 10-2021-0029508 | A | 3/2021 | |
| WO | 2020/071824 | A1 | 4/2020 | |

OTHER PUBLICATIONS

Communication issued on Sep. 20, 2024 by the European Patent Office for European Patent Application No. 22837810.5.

International Search Report and Written Opinion (PCT/ISA/210 and PCT/ISA/237) dated Sep. 5, 2022, issued by International Searching Authority for International Application No. PCT/KR2022/006877.

Communication dated Mar. 26, 2026, issued by the China National Intellectual Property Administration in Chinese Application No. 202280045571.X.

Communication dated May 21, 2026 issued by the European Patent Office in European Patent Application No. 22837810.5.

* cited by examiner

ICE MAKER AND CONTROL METHOD THEREFOR

CROSS-REFERENCE TO RELATED APPLICATION

This application is a bypass continuation application of International Application No. PCT/KR2022/006877, filed on May 13, 2022, which is based on and claims the benefit of a Korean Patent Application No. 10-2021-0088152, filed on Jul. 5, 2021, in the Korean Intellectual Property Office, the disclosures of which are incorporated by reference herein in their entireties.

BACKGROUND

1. Field

The disclosure relates to an ice maker and a method of controlling the same.

2. Description of the Related Art

An ice maker is an apparatus for making ice, in which ice-making is performed by cooling water supplied to an ice-making container. Upon completion of the ice-making, the generated ice is discharged from the ice-making container and moved to a predetermined storage container.

An ice-making container of the ice maker may consist of two trays that can be coupled to each other. In such a two-tray ice-making container, ice-making is performed in a sealed state with the trays coupled together, and upon completion of the ice-making, the trays are uncoupled and the ice is then discharged in an open state, in other words, performing ice-separating.

During an ice-making process, ice may be generated in a water supply guide that supplies water into an ice-making container. Due to the ice generated in the water supply guide, the water supplying to the ice-making container may not operate smoothly while supplying the water or the water supply guide may be blocked by the ice generated therein.

The ice-making container may have two trays that can be coupled together. During the ice-making process, ice may be generated and adhere onto a sealing surface between the coupled trays to further increase a coupling force between those two trays. The increased coupling force between the trays may result in an excessive load onto a driving unit when the trays are uncoupled for ice-separating. Furthermore, when the trays are coupled together for a next ice-making after the ice-separating, a perfect sealing may not be affected due to residual ice adhering to the sealing surface.

SUMMARY

Provided are an ice-maker and a method of controlling the same, capable of removing ice that may be generated on a sealing surface in between trays making up a water supply guide or an ice-making container.

According to an aspect of the disclosure, an ice maker includes an ice-making container including a first tray and a second tray coupled to each other at a sealing surface between the first tray and the second tray; a water supply guide including a first end connected to the ice-making container, the water supply guide being configured to supply water to the ice-making container; a first heater provided adjacent to or in the ice-making container; and a second heater provided adjacent to or in the ice-making container, and provided at a position that is different than a position of the first heater, wherein the first heater is provided closer to the sealing surface than the second heater.

At least a portion of the first heater is provided along the sealing surface.

At least a portion of the first heater may extend from the first end of the water supply guide to a second end of the water supply guide.

The ice maker may further include a housing configured to receive the ice-making container and the water supply guide, the housing has an opening through which the water supply guide may be installed, and at least a portion of the first heater may be provided along the opening.

The ice maker may further include a controller configured to control an operation of the first heater and the second heater; and a driver configured to couple or uncouple the first tray and the second tray; wherein the controller may be further configured to: control the driver to uncouple the first tray and the second tray to cause ice to discharge from the ice-making container, and to couple the first tray and the second tray; and based on the coupling of the first tray and the second tray, control the first heater or the second heater to operate.

The ice maker may further include a driver configured to couple and uncouple the first tray and the second tray; and a controller configured to: control the driver to uncouple the first tray and the second tray to discharge ice from the ice-making container and to couple the first tray and the second tray; and based on the coupling of the first tray and the second tray, control at least one of the first heater or the second heater to operate.

The controller may be further configured to, based on a temperature of the ice-making container reaching a first predetermined temperature or a first predetermined time elapsing, terminate an operation of the at least one of the first heater and the second heater.

The first tray may include a first tray body, the first tray body including a protrusion that protrudes along the sealing surface toward the second tray, the second tray may include a second tray body, the second tray body including an insertion recess configured to receive the protrusion along the sealing surface, and the other one of the first tray body or the second tray body includes a first rib along the sealing surface that protrudes towards the first tray or the second tray, the first rib being configured to deform upon application of pressure.

The first tray further may include a first tray casing enclosing the first tray body, wherein the second tray further may include a second tray casing enclosing the second tray body, and the first tray body further comprises a second rib that protrudes toward the second tray casing and is configured deform under pressure by the second tray casing, or the second tray body further comprises a second rib that protrudes toward the first tray casing and is configured deform under pressure by the first tray casing.

The first tray and the second tray provided in a side-to-side orientation and are configured to be coupled or uncoupled by the first tray and the second tray moving in a horizontal direction.

According to an aspect of the disclosure, a method of controlling an ice maker includes: controlling a driver connected to at least one of a first tray or a second tray of the ice maker to release coupling of the first tray and the second tray, so that ice is discharged from an ice-making container of the ice maker in which the first tray and the second tray are coupled; controlling the driver to couple the first tray and the second tray together; and operating, based on the coupling of the first tray and the second tray, a first heater of the ice maker provided adjacent to a sealing surface at which the first tray and the second tray are coupled or provided adjacent to a water supply guide.

The method may further include, based on the coupling, controlling the first heater to operate, and based on a temperature of the ice-making container reaching a first predetermined temperature or a first predetermined time elapsing, controlling to terminate an operation of the first heater.

The method may further include controlling the first heater to cease operation, and supplying water to the ice-making container via the water supply guide.

The method may further include, based on the coupling, controlling a second heater that is provided within or adjacent to the first tray and is provided at a position different from a position of the first heater.

The method may further include, based on the coupling, performing operating the first heater and the second heater, and supplying water to the ice-making container via the water supply guide.

According to an aspect of the disclosure, an apparatus includes: a container including a first tray and a second tray coupled to each other at a sealing surface between the first tray and the second tray; a water supply guide including a first end connected to the container, the water supply guide being configured to supply water to the container; a first heater provided adjacent to or in the container; and a second heater provided adjacent to or in the container, and provided at a position that is different than a position of the first heater, wherein the first heater is provided closer to the sealing surface than the second heater.

At least a portion of the first heater may be provided along the sealing surface.

At least a portion of the first heater may extend from the first end of the water supply guide that is connected to the container to a second end of the water supply guide.

The apparatus may include a housing configured to receive the container and the water supply guide, wherein an opening through which the water supply guide may be installed is formed in the housing, and wherein at least a portion of the first heater may be provided along the opening.

The apparatus may include: a driver configured to couple and uncouple the first tray and the second tray; and a controller configured to: control the driver to uncouple the first tray and the second tray to cause ice to discharge from the container, and to couple the first tray and the second tray; and based on the coupling of the first tray and the second tray, control at least one of the first heater or the second heater to operate.

Further, to address the technical problems described above, according to an embodiment of the disclosure, a method of controlling an ice maker may comprise controlling a driver connected to at least one of a first tray or a second tray of the maker to release coupling of the first tray and the second tray, so that ice is discharged from an ice-making container of the ice maker in which the first tray and the second tray are coupled, controlling the driver to couple the first tray and the second tray together, and controlling, based on the coupling of the first tray and the second tray, a first heater of the ice maker provided adjacent to a sealing surface at which the first tray and the second tray are coupled or provided adjacent to a water supply guide.

According to one or more embodiments of the disclosure, a heater may be configured to operate prior to feeding water to the ice-making container to remove residual ice that may have formed and remained on the water supply guide, thereby facilitating water supplying.

Furthermore, according to one or more embodiments of the disclosure, it may be possible to remove any residual ice that may be generated on the sealing surface of the trays constituting the ice-making container, owing to operating the heater before feeding water to the ice-making container, thereby reducing an excessive load onto the driver while driving the trays, and ensuring the ice-making container to be tightly sealed when the trays are coupled again for a next batch of ice-making after ice-separating, thereby preventing leakage.

The effects that can be obtained from example embodiments of the disclosure are not limited to those described above, and other effects not mentioned herein may be clearly derived and understood by those having ordinary knowledge in the technical field to which the example embodiments of the disclosure belong from the following description. In other words, any unintended effects accruing from practicing the exemplary embodiments of the disclosure may also be easily derived from the embodiments of the disclosure by those having ordinary knowledge in the art.

BRIEF DESCRIPTION OF THE DRAWINGS

The above and other aspects, features, and advantages of embodiments of the disclosure will be more apparent from the following description taken in conjunction with the accompanying drawings, in which.

DETAILED DESCRIPTION

Figure 1:
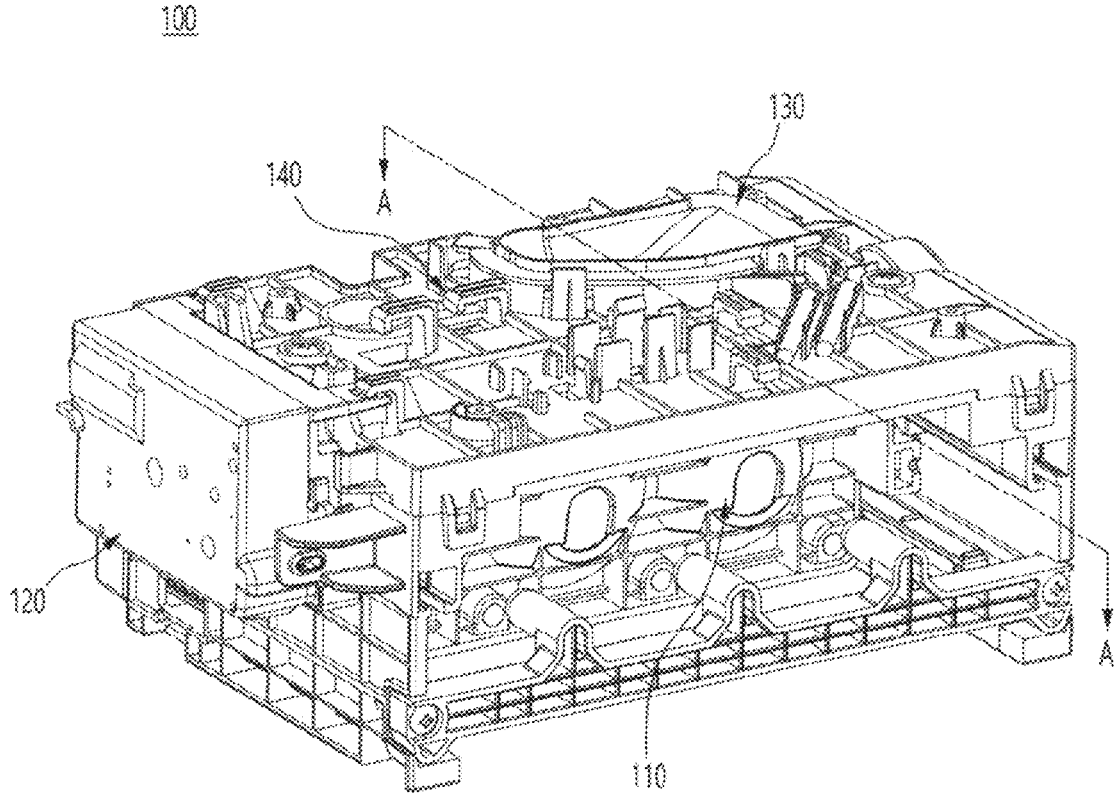
FIG. 1 is a front perspective view of an ice maker according to an embodiment of the disclosure.

The embodiments described herein and the configurations illustrated in the drawings are merely examples, and there may be various modifications that may be substituted for the embodiments and drawings described herein at the time of filing of this application. In the following description, certain details, such as specific configurations and components, are provided merely to provide a general understanding of the embodiments of the disclosure. Accordingly, it is to be understood that various changes and modifications may be made to the embodiments described herein without departing from the scope and spirit of the disclosure. Further, the descriptions of well-known features and configurations may be omitted for the sake of clarity and brevity.

Further, the same or like reference numerals or symbols shown in each drawing of the disclosure designate parts or components that perform substantially the same or like functions.

Further, the terms used herein are only for the purpose of describing the embodiments and are not intended to limit and/or define the disclosure. The singular expression includes the plural expression unless the context clearly indicates otherwise. As used herein, the terms "include", "comprise", or "have" are intended to designate the presence of the features, numbers, steps, actions, components, parts, or combinations thereof described in the specification, and do not preclude the possibility of the presence or addition of one or more other features, numbers, steps, actions, components, parts, or combinations thereof.

Further, ordinal terms such as "first", "second" and the like as used herein may be used to describe various components, but the corresponding components are not limited by those terms, and the terms are used only for the purpose of distinguishing one component from another. For example, without departing from the scope of the disclosure, a first component may be named as a second component, and likewise, a second component may be named as a first component.

Furthermore, when a component is described herein as being "connected" to another component, it means that the two components are not only directly connected, but also connected to each other with other component interposed therebetween. Further, when a component is described herein as being "adjacent" to another component, it means encompassing that the two components are not only in contact with each other, but also are placed close to each other with other components interposed therebetween.

In addition, the term "and/or" includes a combination of a plurality of related recited items or any one of a plurality of related recited items.

Throughout the disclosure, the expression "at least one of a, b or c" indicates only a, only b, only c, both a and b, both a and c, both b and c, or all of a, b, and c.

Below, example embodiments will be described in greater detail referring to the accompanying drawings.

FIG. 1 is a perspective view of an ice maker according to an embodiment of the disclosure.

An ice maker 100 may be installed in a refrigerating or a freezing apparatus, such as a refrigerator, or may be used independently. Referring to FIG. 1, the ice maker 100 may include an ice-making container 110, a driving unit or driver 120, a water supply guide 130, and a housing 140.

The ice-making container 110 may be provided with a space to receive and hold water for making ice. The ice-making container 110 may be configured to include two trays to be coupled together, as described later. The two trays of the ice-making container 110 may have a predetermined coupling structure and may be sealed to prevent leakage during watering and ice-making.

The driving unit 120 may be configured to drive an opening and a sealing of the ice-making container 110. The driving unit 120 includes a motor and a gear assembly connected thereto, and may be connected to at least one of trays constituting the ice-making container 110. Operation of the driving unit 120 may be controlled by a controller to be described later, and as the driving unit 120 is driven, the trays of the ice-making container 110 connected thereto is moved, causing opening or closing of the ice-making container 110.

The water supply guide 130 may be configured to perform a function of supplying water to the ice-making container 110. The water supply guide 130 may be configured with a funnel-like shape. One end of the water supply guide 130 may be connected to an opening formed in the housing 140 to be described later, and the other end thereof may be connected to the ice-making container 110. The water supply guide 130 may feed water into the ice-making container 110.

The housing 140 is configured to provide a space to accommodate and install each component of the ice maker 100 therein. As shown in FIG. 1, the ice-making container 110 may be accommodated within the housing 140, and the driving unit 120 may be arranged on one side of the housing 140. In an embodiment, the housing 140 may be formed with an opening through which the water supply guide 130 is installed. In an embodiment, the opening in the housing 140 may be configured to receive a water supply from the outside, with one end of the water supply guide 130 located therein. When the ice maker 110 is installed in an external appliance, such as the freezer compartment of a refrigerator, the housing 140 may be removably mounted to that external appliance. In the meantime, the size, shape, etc. of the housing 140 is not limited to those shown herein and may be varied depending on the size and shape of the ice-making container 110, the shape of the external appliance in which the ice maker 100 is installed, and so on.

The ice maker 100 may further include a storage container for receiving and storing ice generated in the ice-making container 110. The storage container may be disposed beneath the ice-making container 110 to accommodate the ice when the ice is discharged from the ice-making container 110 following completion of the ice-making, i.e., upon ice-separating, and may be detachably mounted to allow for easy access to the ice by a user.

The ice maker 100 may include a heater to control transparency of the ice during icing, and also to remove residual ice after the ice-making. Specifically, the heater may function to remove residual ice from the water supply guide 130 or residual ice from a sealing surface to which the trays making up the ice-making container 110 are coupled.

Figure 2:
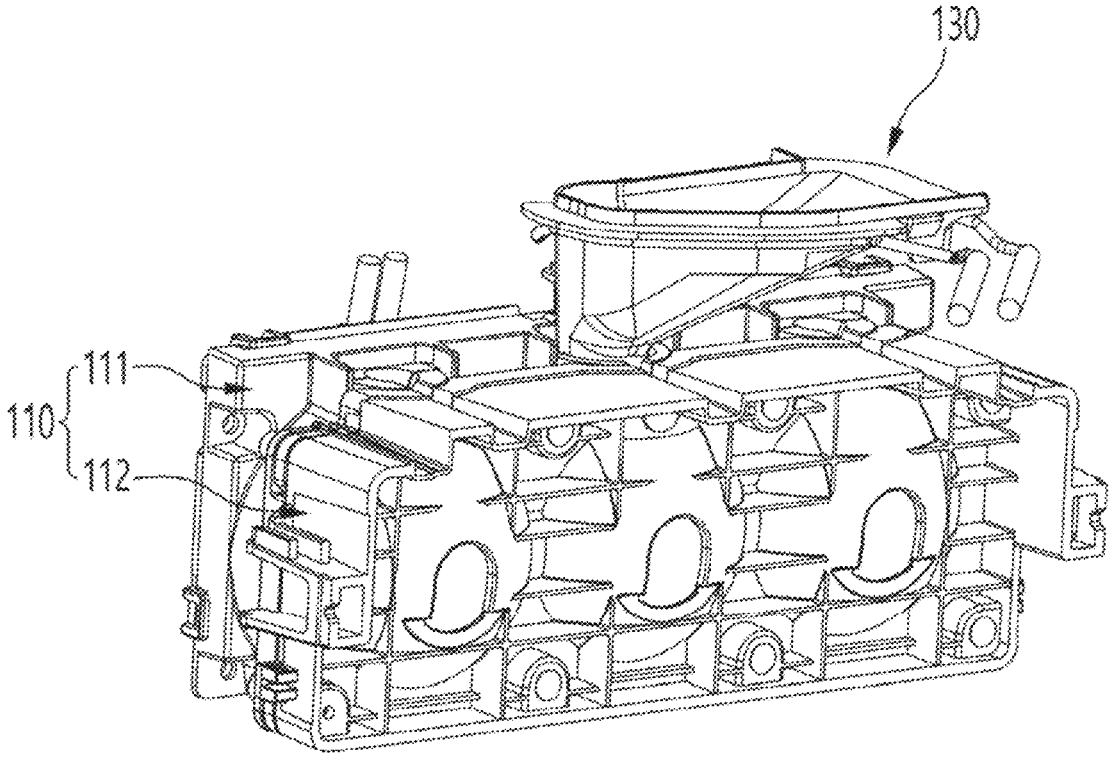
FIGS. 2 and 3 are, respectively, front and rear perspective views of an ice-making container with a water supply guide connected thereto, according to an embodiment of the disclosure.
Figure 3:
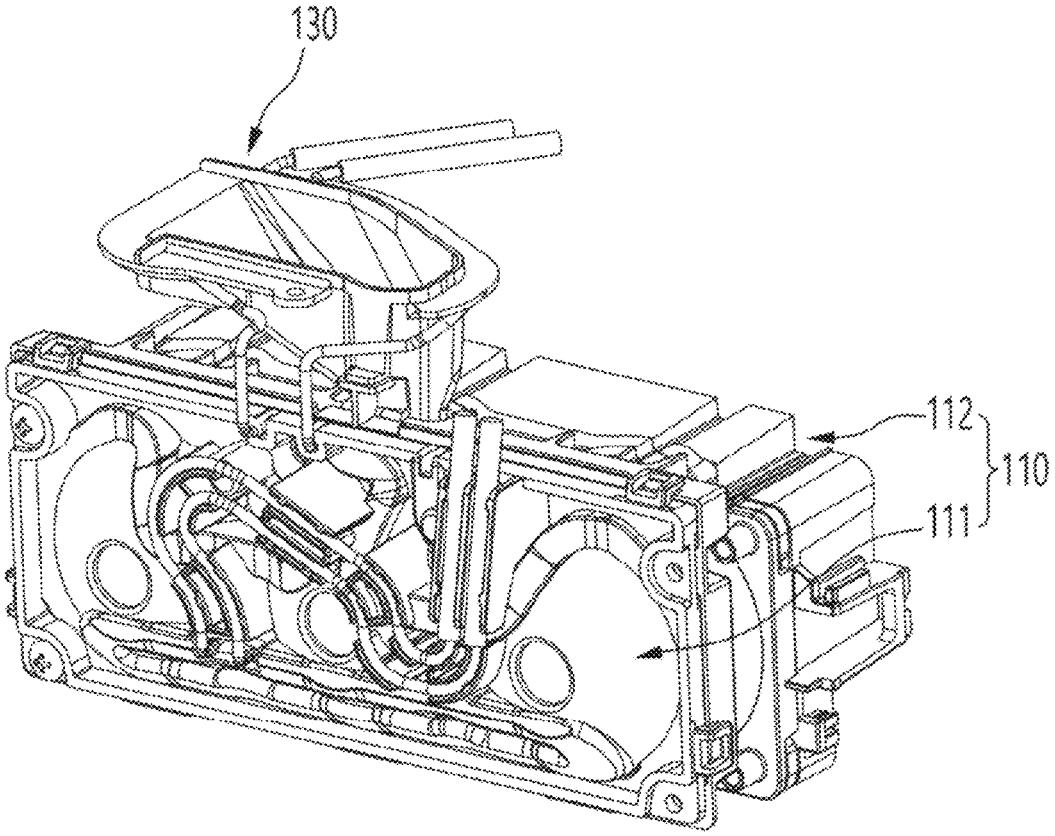

FIGS. 2 and 3 respectively illustrate front and rear perspective views of an ice-making container with a water supply guide connected thereto, according to an embodiment of the disclosure.

Referring to FIG. 2 or 3, the ice-making container 110 may include a first tray 111 and a second tray 112. The first tray 111 and the second tray 112 may be coupled or uncoupled. The first tray 111 and the second tray 112 may be configured to be coupled to each other during watering and icing to form a chamber, which is an interior space for receiving water, and may be configured to be detached from each other to discharge ice during ice-separating. In an embodiment, either the first tray 111 or the second tray 112 may be configured to release the coupling of the first tray 111 and the second tray 112 as at least one of them is moved. In an embodiment of the disclosure, as shown, the first tray 111 and the second tray 112 may be configured to be arranged in a side-to-side orientation such that they are coupled or decoupled, as at least one of them moves in a horizontal direction. Alternatively, the first tray and the second tray may be configured to be arranged in an up-and-down direction such that they are coupled or decoupled, as at least one of them travels in a vertical direction. Further, it would be also possible for the trays to have a hinged coupling structure or any other known coupling structure. The disclosure is not limited to the coupling structures described above, and those skilled in the art will recognize that various known coupling structures may be utilized.

The ice-making container 110 may be connected to the water supply guide 130. A chamber in the ice-making container 110 may be in communication with the water supply guide 130, so that water may be fed through the water supply guide 130.

Figure 4:
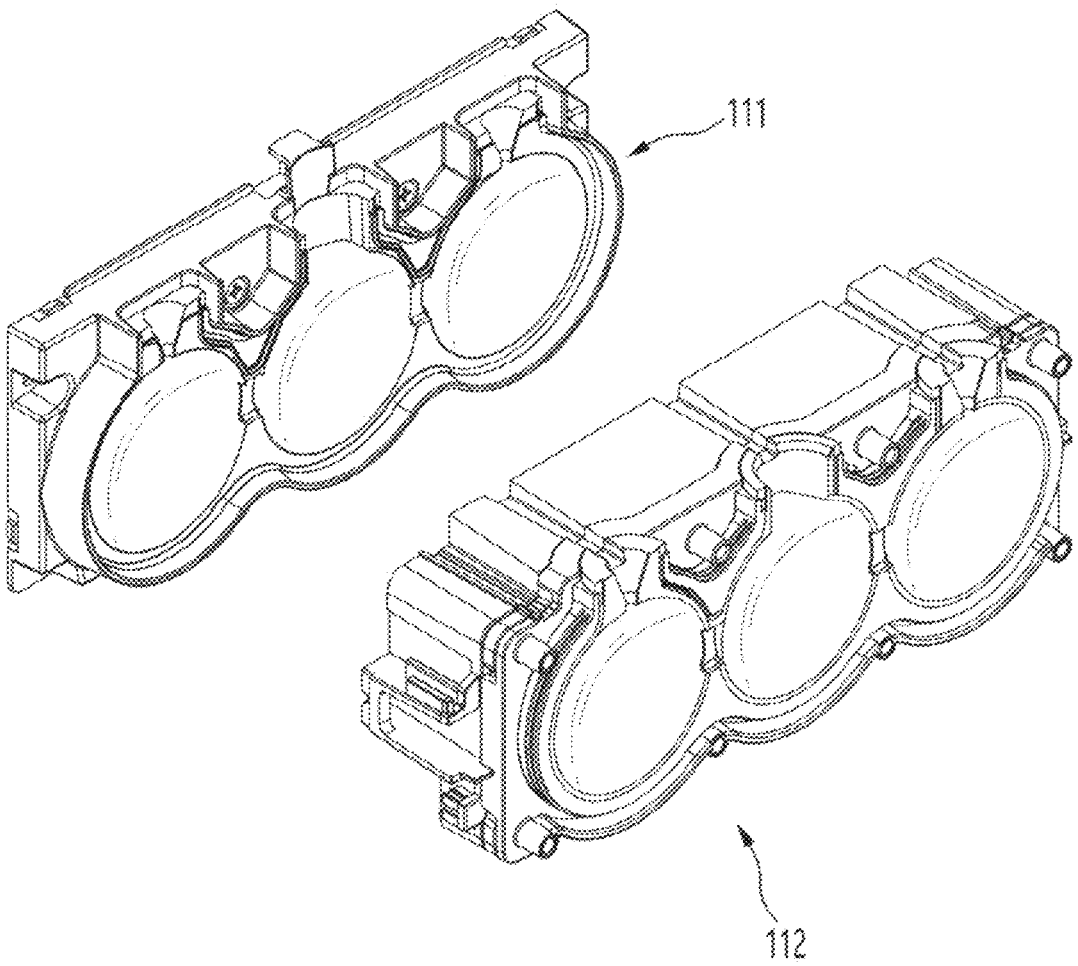
FIG. 4 is a drawing illustrating a first tray and a second tray according to an embodiment of the disclosure.

FIG. 4 is a drawing illustrating a first tray and a second tray according to an embodiment of the disclosure.

Referring to FIG. 4, the first tray 111 and the second tray 112 may each have a hemispherical receptacle such that a spherical chamber is formed when combined. The receptacles of the first tray 111 and the receptacles of the second tray 112 may be arranged in corresponding pairs, such that the corresponding number of pairs of ice chunks may be produced in each ice-making cycle. Further, a plurality of chambers formed when the first tray 111 and the second tray 112 are coupled together may be in fluid communication. For example, as shown in herein, a through-hole may be formed in the center of a chamber, so that the chambers located adjacent to each other may be in fluid communication via the through-hole. Accordingly, water may be supplied to all chambers even if the water supply guide 130 is connected to only one chamber. The number of chambers, shapes, sizes, and so on of the ice-making container 110 are not limited to those shown herein, and may vary depending on the purpose of use, application, or the like.

Figure 5:
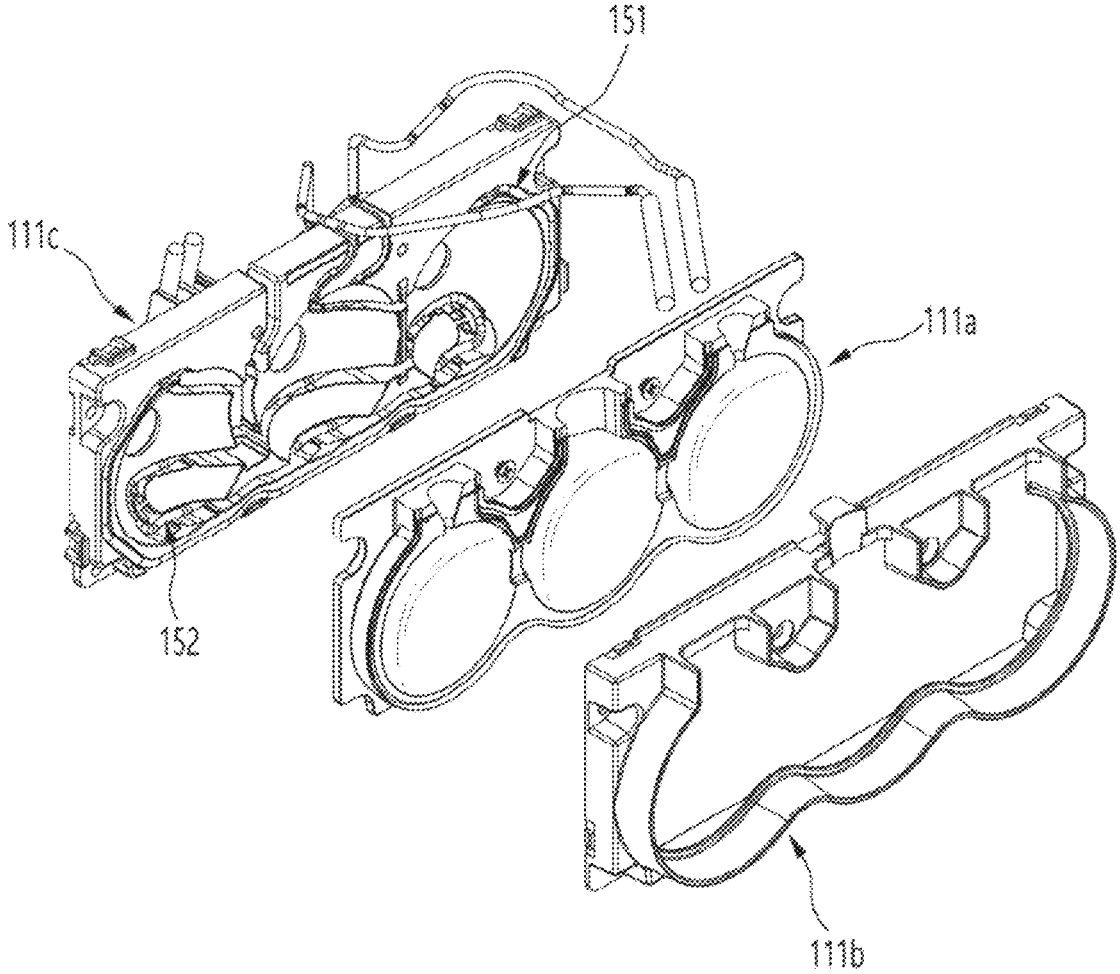
FIG. 5 is an exploded view of a first tray according to an embodiment of the disclosure.

FIG. 5 is an exploded perspective view of a first tray according to an embodiment of the disclosure.

Referring to FIG. 5, the first tray 111 may be configured to have a first tray body 111*a*, a first tray casing 111*b*, and a first tray cover 111*c*. The first tray body 111*a* may have a receptacle formed to receive water to make up an ice-making chamber. The first tray casing 111*b* may be configured to enclose the first tray body 111*a*. The first tray cover 111*c* may be disposed on one side of the first tray body 111*a* and may be disposed on the opposite side where the receptacle of the first tray body 111*a* is formed.

A first heater 151 and a second heater 152 may be disposed adjacent to or within the first tray 111, respectively, and may be configured to apply heat to the ice-making container 110 or around the ice-making container 110. The first heater 151 and the second heater 152 may be arranged at different positions. For example, the first heater 151 and the second heater 152 may each be installed in the first tray cover 111*c* on a side adjacent to the first tray body 111*a*. The first heater 151 and the second heater 152 may be installed between the first tray body 111*a* and the first tray cover 111*c*, respectively. The first heater 151 and the second heater 152 may be configured in various forms, including the form of wire, and the types of heaters are not limited thereto.

Figure 6:
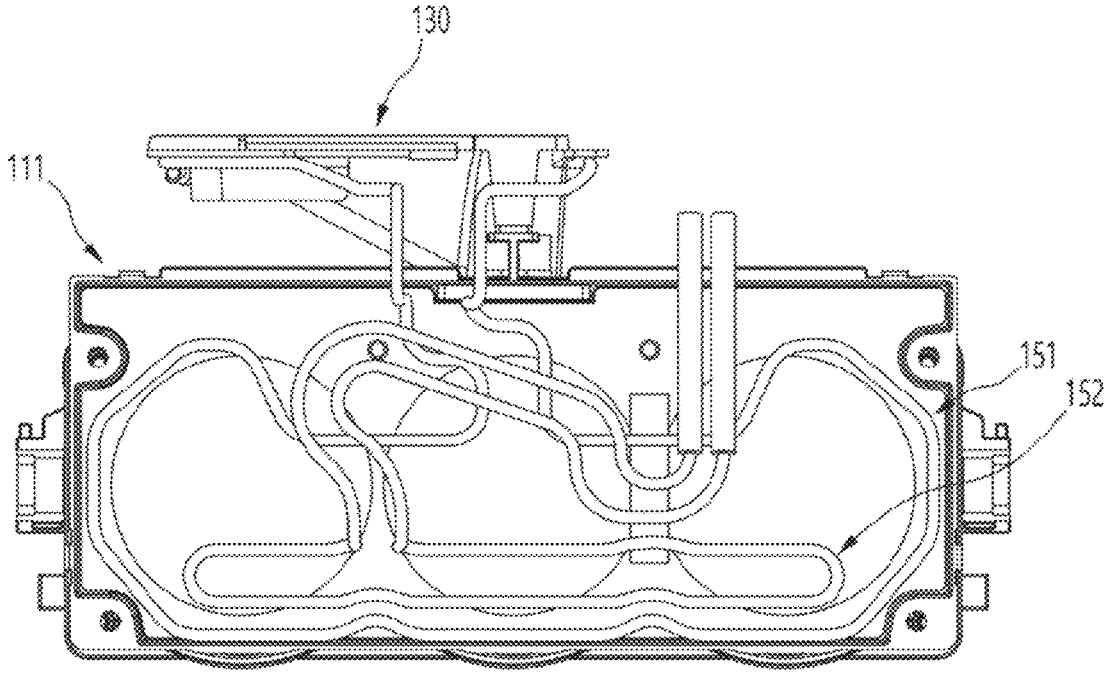
FIG. 6 is a schematic drawing illustrating heaters installed in an ice maker according to an embodiment of the disclosure.

FIG. 6 is a drawing illustrating an example of a heater installed in an ice maker according to an embodiment of the disclosure.

Referring to FIG. 6, a water supply guide 130 is configured to have one end connected to the ice-making container 110 to supply water into the ice-making container 110.

At least a portion of the first heater 151 may be disposed around a periphery of the chamber of the ice-making container 110, that is, adjacent to a sealing surface of the first tray 111 and the second tray 112. Further, at least another portion of the first heater 151 may be disposed adjacent to the water supply guide 130. In an embodiment, at least a portion of the first heater 151 may be configured to extend around the periphery of the chamber of the ice-making container 110 to be disposed adjacent to the water supply guide 130 from one end of the water supply guide 130 connected with the ice-making container 110 to the other end of the water supply guide 130 to which water is supplied from the outside. In an embodiment, the first heater 151 may be disposed adjacent to the water supply guide 130 located on the housing 140. For example, the first heater 151 may be disposed along an opening formed in the housing 140, through which the water supply guide 130 is installed, and may be formed to wrap around a portion of the water supply guide 130. Further, the first heater 151 may be disposed in contact with or spaced apart from the water supply guide 130.

The first heater 151 may operate under the control of a controller upon completion of ice-making to facilitate discharge of ice from the ice-making container 110. The first heater 151 may also operate under the control of the controller during an ice-separating operation to facilitate discharge of ice from the ice-making container 110.

The first heater 151 may be operated by the control of the controller after completion of ice-separating and prior to water supplying to remove residual ice from the sealing surface between the first tray 111 and the second tray 112 or in the water supply guide 130. The first tray 111 and the second tray 112 may be tightly coupled in sealing to prevent leakage during water supplying and ice-making, and thus, it is possible to prevent water supply from being delayed or malfunctioning due to residual ice in the water supply guide 130.

Furthermore, the first heater 151 may be controlled by the controller to cease operation when the temperature of the ice-making container 110 reaches a predetermined temperature or when a predetermined time elapses.

The second heater 152 may be disposed at a different position from the first heater, such as disposed adjacent to the ice-making container 110 or disposed within the ice-making container 110. In an embodiment, the second heater 152 may be disposed adjacent to or below a center portion of the receptacle of the first tray 111 that forms the chamber of the ice-making container 110. In an embodiment, both the first heater 151 and the second heater 152 may be arranged to apply heat to the sealing surface between the first tray 111 and the second tray 112, in which case the first heater 151 may be disposed closer to the sealing surface than the second heater 152.

The second heater 152 may operate under the control of the controller during ice-making to allow bubbles in the water to be expelled to the outside to produce clear ice. When heat is transferred by the second heater 152 during the ice-making process, air bubbles in the water may move from a portion of the water that is freezing to another portion of the water in a pre-freezing state, and may be discharged to the outside without being dispersed within the ice. Describing in more detail, the water in the ice-making container 110 is frozen by cold air of a cooling unit 260, and the freezing starts at the top of the ice-making container 110 where the cold air of the cooling unit 260 enters first, such as at the top of the ice-making container 110 that is open for water supply. As heat is transferred by the second heater 152, air bubbles in the water move from the portion of the water undergoing freezing to the portion of the water that is in a pre-freezing state. As described above, when the first tray 111 and the second tray 112 are arranged in a side-to-side orientation so that at least one of them is configured to be coupled or decoupled as it moves in a horizontal direction, the second heater 152 may be located in the fixed tray. At this time, a portion of the ice-making container 110 adjacent to the second heater 152, i.e., the fixed tray, may be the last to freeze, and some of the air bubbles that have not been expelled to the outside may cause localized opaque areas in the ice, but overall clear ice may be produced.

The second heater 152 may operate under the control of the controller upon completion of the ice-making process, to facilitate discharging of the ice from the ice-making container 110. The second heater 152 may also be operated by the controller upon ice-separating, to facilitate discharging of the ice from the ice-making container 110.

The second heater 152 may be operated by the control of the controller after completion of ice-separating and prior to water supplying, to remove residual ice from the sealing surface between the first tray 111 and the second tray 112 or in the water supply guide 130. The first tray 111 and the second tray 112 may be tightly coupled to seal so as to prevent leakage during water supplying and ice-making, and it is possible to prevent water supplying from being delayed or malfunctioning due to residual ice in the water supply guide 130.

As described above, the first heater 151 and the second heater 152 may be operated under the control of the controller to produce clear ice and facilitate ice-separating as well as to remove residual ice, thereby preventing undesirable problems that may be caused by residual ice during the process of water supplying and ice-making.

Figure 7:
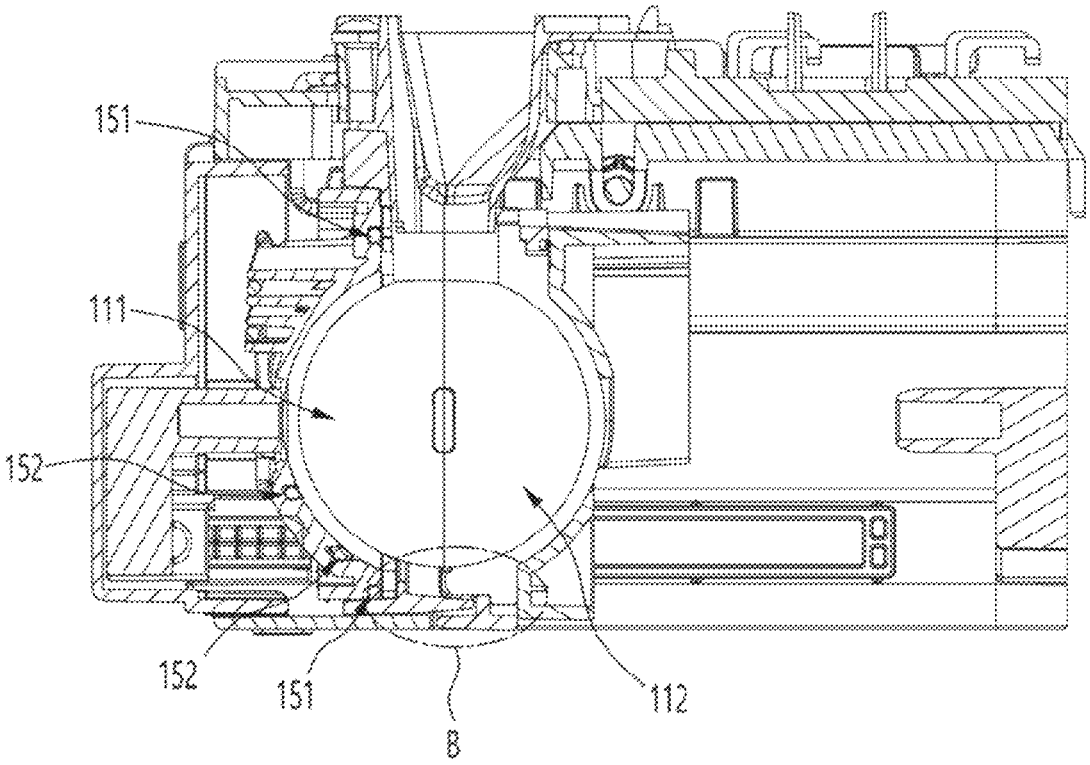
FIG. 7 is a cross-sectional view of an ice maker of FIG. 1 taken along line A-A.

FIG. 7 is a cross-sectional view of the ice maker of FIG. 1 taken along line A-A.

Referring to FIG. 7, the first tray 111 and the second tray 112 may have a predetermined coupling structure to ensure a tight sealing when they are coupled. The first tray 111 and the second tray 112 may each have a coupling structure, and when coupled, they may form a sealing surface B to seal the ice-making container 110. The first tray 111 and the second tray 112 may each form a sealing surface along a periphery of the chamber created by coupling of the first tray 111 and the second tray 112. In an embodiment, the coupling structure of the first tray 111 may have a protrusion and the coupling structure of the second tray 112 may have an insertion recess corresponding to the protrusion, such that the protrusion is fitted into the insertion recess. When the first tray 111 and the second tray 112 are coupled, the protrusion and the insertion recess are hermetically coupled to make a sealing.

Figure 8A:
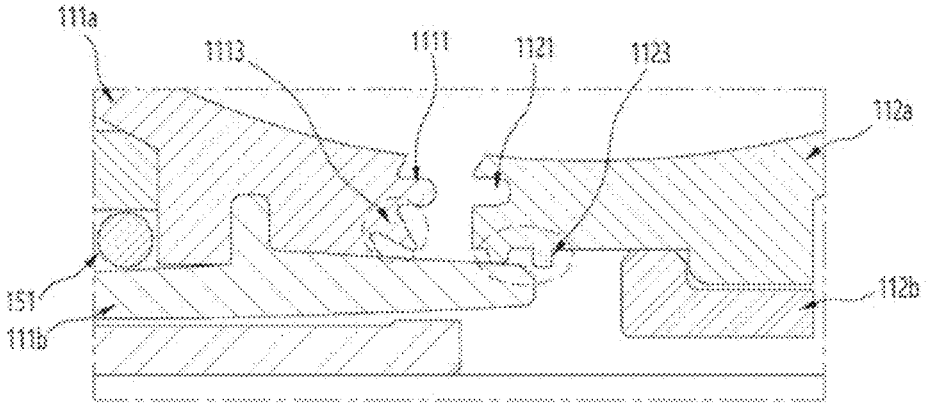
FIGS. 8A and 8B are cross-sectional views illustrating coupling of a first tray and a second tray, according to an embodiment of the disclosure.
Figure 8B:
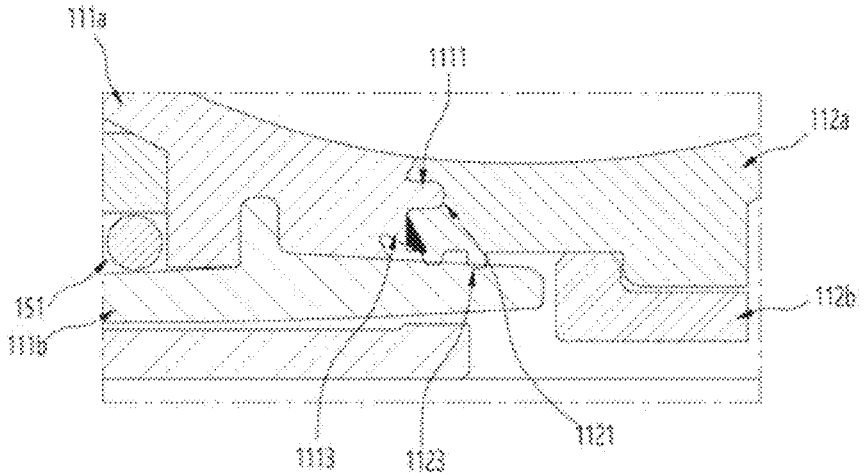

FIGS. 8A and 8B are cross-sectional views illustrating coupling of the first tray and second tray according to an embodiment of the disclosure.

FIG. 8A shows a state before the first tray 111 and the second tray 112 are coupled, and FIG. 8B shows a state after the first tray 111 and the second tray 112 are coupled.

Referring to FIG. 8A, the first tray body 111*a* of the first tray 111 may have a coupling structure formed along the sealing surface. The coupling structure formed on the first tray body 111*a* may include a protrusion 1111 that projects in a direction facing the second tray 112. Further, the coupling structure formed on the first tray body 111*a* may include a first rib 1113. The first rib 1113 may be formed in a direction facing the second tray 112 and may deform when pressure is applied in the direction of coupling of the first tray 111 and the second tray 112. The first rib 1113 has a shape that protrudes obliquely toward the second tray 112 to facilitate deformation when pressure is applied.

The second tray 112, similar to the first tray 111, may include a second tray body 112*a* in which a hemispherical receptacle is formed and a second tray casing 112*b* enclosing the second tray body 112*a*. The second tray body 112*a* may have a coupling structure formed along the sealing surface. In the coupling structure formed in the second tray body 112*a* may be formed an insertion recess 1121 that fits the shape of the protrusion 1111. The insertion recess 1121 is formed at a position corresponding to the protrusion 1111 when the first tray 111 and the second tray 112 are coupled to each other. Further, the coupling structure formed on the second tray body 112*a* may include a second rib 1123. The second rib 1123 may be formed to protrude outward of the second tray body 112*a*, that is, radially outward, and may be configured to deform when pressure is applied in the opposite direction (i.e., radially inward).

Referring to FIG. 8B, when the first tray 111 and the second tray 112 are coupled by the coupling structure of the first tray 111 and the coupling structure of the second tray 112, a sealing surface is formed by fitting the protrusion 1111 and the insertion recess 1121, and thus, sealing is performed.

When the first tray 111 and the second tray 112 are coupled, the first rib 1113 of the first tray 111 is pressed and deformed by a corresponding surface of the second tray 112 and is brought into close contact with the corresponding surface of the second tray 112. Thus, additional sealing is performed in the coupling direction of the first tray 111 and the second tray 112.

When the first tray 111 and the second tray 112 are coupled together, the second rib 1123 of the second tray 112 is pressed and deformed in a direction opposite to the direction protruded by the first tray casing 111*b* of the first tray 111, that is, in a radially inward direction. The second rib 1123 comes into close contact with the first tray casing 111*b* to provide an additional sealing in the radial direction.

When the first tray 111 and the second tray 112 are coupled, additional sealing by the first rib 1113 and the second rib 1123 is made in addition to sealing by fitting the protrusion 1111 of the first tray 111 and the insertion recess 1121 of the second tray 112. The sealing of the first tray 111 and the second tray 112 may be maintained with such multiple sealings, thereby preventing leakage during the water supplying and ice-making process.

The coupling structure of the first tray 111 and the coupling structure of the second tray 112 may be integrally formed with the first tray body 111*a* and the second tray body 112*a*, respectively. In such a circumstance, the first tray body 111*a* and the second tray body 112*a* may be made of a material having excellent elasticity and flexibility, respectively. Alternatively, it is also possible for at least one of the coupling structure of the first tray 111 or the coupling structure of the second tray 112 to be formed with a separate member from the first tray body 111*a* and the second tray body 112*a*. In such a case, the coupling structure formed separately from the first tray body 111*a* and the second tray body 112*a* may be made of a material having good elasticity and flexibility so that the sealing can be maintained while being deformed by the pressure applied during its coupling.

The shape, size, number, etc., of the coupling structure of the first tray 111 and the second tray 112 are not limited to those shown, and may be variously changed within a range capable of implementing such multiple sealings. For example, while one protrusion 1111 and one insertion recess 1121 are illustrated in the drawing, it is to be appreciated that multiple protrusions may be formed. Further, while it is illustrated that two second ribs 1123 are formed in the drawing, it is to be appreciated that their number may be changed to one, three, or more. Further, while the first rib 1113 is illustrated as being formed on the first tray body 111*a*, it may be formed on the second tray body 112*a*. Similarly, while the second rib 1123 is illustrated as being formed on the second tray body 112*a*, it may be formed on the first tray body 111*a*.

In the meantime, ice may be also generated in the coupling structure during the ice-making process. Such remaining ice, that is, residual ice, may cause problems with the sealing between the first tray 111 and the second tray 112 during the coupling process of the first tray 111 and the second tray 112. To prevent that problem, as described above, at least one of the first heater 151 or the second heater 152 may be used to perform removal of the residual ice.

The operation of each component of the ice maker 110 described above may be controlled by a controller.

Figure 9:
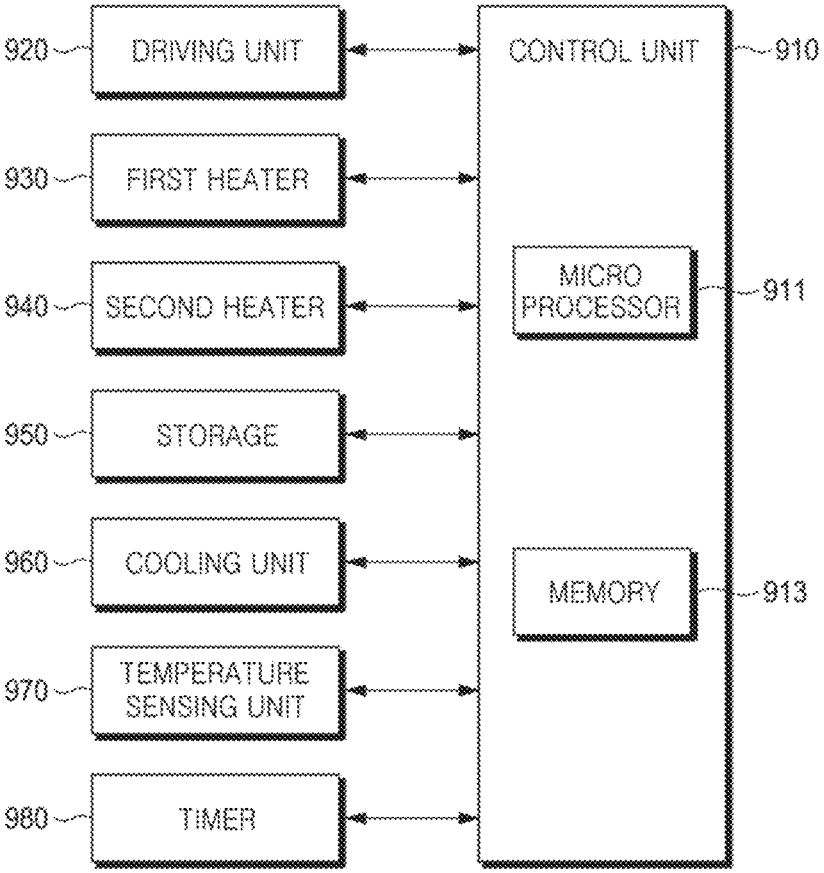
FIG. 9 is a block diagram of an ice maker according to an embodiment of the disclosure.

FIG. 9 is a block diagram of an ice maker according to an embodiment of the disclosure.

Referring to FIG. 9, the ice maker 100 may further include a control unit or controller 910, a driving unit or driver 920 (e.g., corresponding to the driving unit 120 of FIG. 1), a first heater 930 (e.g., corresponding to the first heater 151 of FIG. 5), a second heater 940 (e.g., corresponding to the second heater 152 of FIG. 5), a storage 950, a cooling unit 960, a temperature sensing unit 970, and a timer 980.

The control unit 910 may control the operation of each component. The control unit 910 may perform the functions to overall control each component of the ice maker 100 to produce ice and remove residual ice according to a user-set or preset icing mode, cooling temperature, or the like. To this end, the control unit 910 may be configured to be operatively connected to each of components of the ice maker 100 to control their operation.

The control unit 910 may be implemented with an integrated circuit with control functions, such as system-on-chip (SoC), or a control board including a general purpose processor, such as central processing unit (CPU) or micro processing unit (MPU), and software. The general-purpose processor may include a control program (or instructions) for perform a control operation, a non-volatile memory in which the control program is installed, a volatile memory in which at least part of the installed control program is loaded, and at least one processor or CPU for executing the loaded control program.

For example, the control unit 910 may include a microprocessor 911 and a memory 913.

The microprocessor 911 may fetch data stored in the memory 913 according to a program stored in the memory 913, and may perform arithmetic operations or logical operations on the fetched data. Further, the microprocessor 911 may output a result of the arithmetic or logic operations to the memory 913. The memory 913 may include a volatile memory that loses its stored data when the power supply is interrupted. The volatile memory can retrieve programs and data from a storage 950, which will be described later, and temporarily store the retrieved data. Further, the volatile memory may provide the stored programs and data to the microprocessor 911, and may store data output from the microprocessor 911. Such a volatile memory may include S-ram, D-ram, or the like.

While the microprocessor 911 and the memory 913 have been described as functionally distinct from each other, the microprocessor 911 and memory 913 are not necessarily physically distinguished. For example, the microprocessor 911 and the memory 913 may be implemented on separate chips, as well as with a single chip.

The driving unit 920 may drive a motor related to the opening and closing operation of the ice-making container 110 according to a drive control signal from the control unit 910.

The first heater 930 and the second heater 940 may operate to provide heat according to the drive control signal of the control unit 910.

The storage 950 may store control programs and control data to control the operation of the ice maker 100, and various application programs and application data to perform various functions according to a user input. Further, the storage 950 may store a temperature control value for the ice-making container 110 determined by the control unit 910. For example, the storage 950 may be configured to store data such as e.g., a detection period of the temperature sensing unit 970 to be described later, or an operating time or power amount of the first heater 930 or the second heater 940 based on the result of detection of the temperature sensing unit 970, and further, to store various programs such as e.g., a control program for controlling the ice maker 100, a dedicated application originally provided by the manufacturer, a general-purpose application downloaded from the outside, or the like.

The cooling unit 960 may be configured to perform a function of cooling water by providing cold air to or around the ice-making container 110 under the control of the control unit 910. Alternatively, the cooling unit 960 may be implemented as a separate device from the ice maker 100. For example, when the ice maker 100 is installed in an external apparatus, such as a freezer compartment of a refrigerator, the cooling unit 960 may be installed separately in that external apparatus to provide cold air to the ice maker 100.

The temperature sensing unit 970 may detect the temperature of the ice-making container 110 to transmit the detected temperature to the control unit 910. The temperature sensing unit 970 may include one or more temperature sensors arranged at a certain position inside the ice-making container 110, such as a ceiling, a bottom, or interior walls of the ice-making container 110, to detect the temperature inside the ice-making container 110.

The timer 980 may count the operating time duration of the first heater 930 and the second heater 940.

The ice maker 100 may further include various other sensors as necessary, such as a sensor for measuring whether or not the ice-making container 110 is open or the degree to which it is open, or a sensor for detecting whether or not icing is completed, and the like. These sensors may be connected to the control unit 910 to enable accurate control of each component by the control unit 910.

Hereinafter, a method of controlling the ice maker via the control unit 910 will be described in detail.

Figure 10:
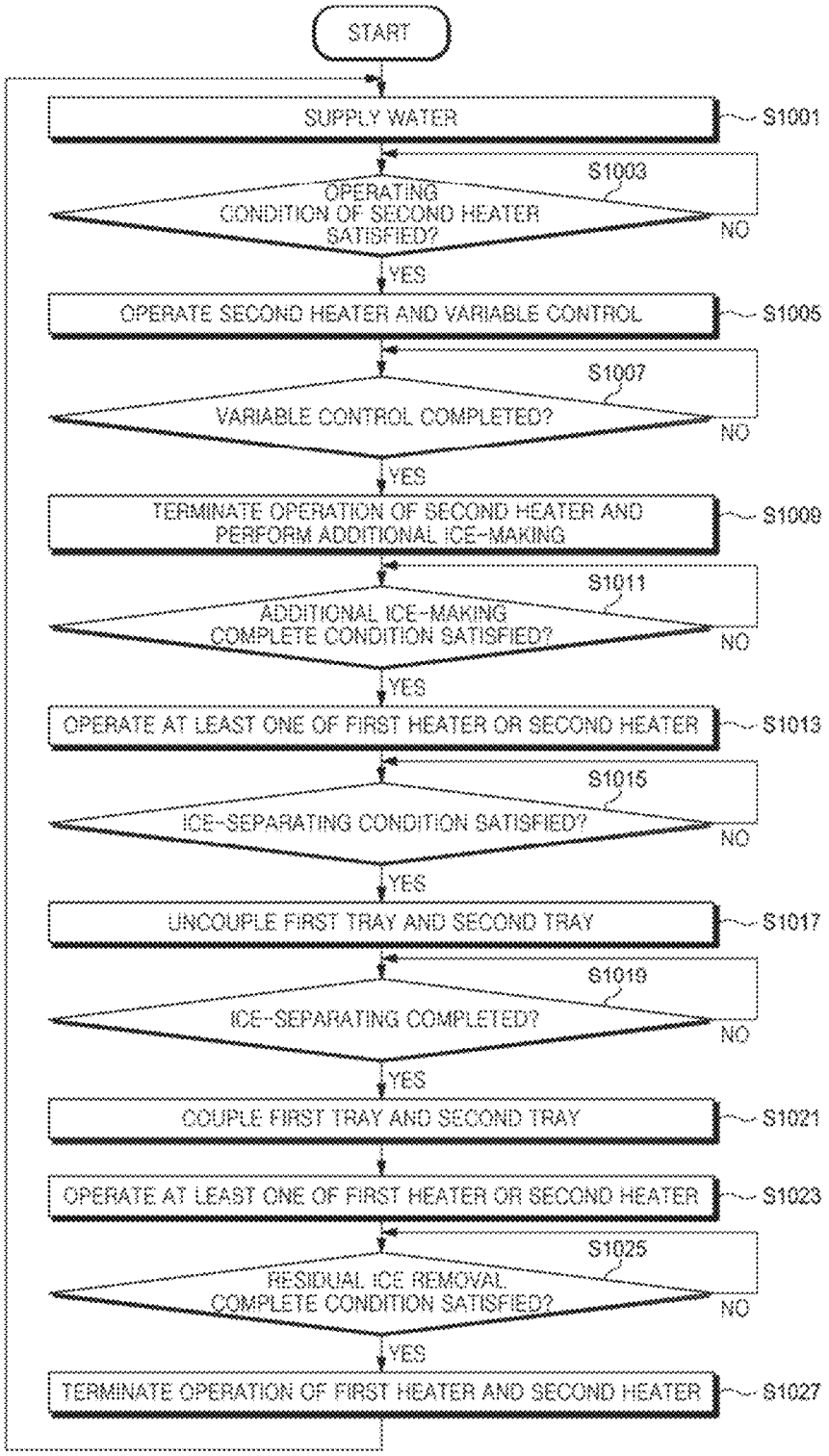
FIG. 10 is a flowchart to describe an ice-making process in an ice maker according to an embodiment of the disclosure.

FIG. 10 is a flowchart to illustrate an example of a process of ice-making in the ice maker according to an embodiment of the disclosure.

Referring to FIG. 10, water is supplied to a chamber of the ice-making container 110 (S1001). Simultaneously with supplying the water, or when the water supplying is completed, the cooling unit 960 performs, under the control of the control unit 910, ice-making by providing cold air to the ice-making container 110 or around the ice-making container 110 to cool the water.

Then, it is determined whether an operating condition of the second heater 940 is satisfied (S1003). The operating condition of the second heater 940 may be based on whether the temperature of the ice-making container 110 has reached a predetermined temperature or whether a predetermined time has elapsed after the water supplying is completed. For example, the predetermined temperature may be set to 0° C., which is the temperature at which the water begins to freeze, and the predetermined time may be set to a maximum of 30 minutes.

When the operating condition of the second heater 940 is satisfied in full, the control unit 910 operates the second heater 940 (S1005). The second heater 940 is operated by the control of the control unit 910 during ice-making, so that air bubbles in the water may be discharged to the outside during the ice-making process to produce clear ice. For example, when heat is transferred by the second heater 940 during the ice-making process, air bubbles in the water may move from the freezing part to a pre-freezing part of the water, and may be then discharged to the outside without being dispersed in the ice. By way of explanation, as the water in the ice-making container 110 is frozen by the cold air supplied from the cooling, the freezing first starts, for example, from the top of the ice-making container 110 open for water supplying, where the cold air from the cooling first flows in. When heat is transferred by the second heater 152, air bubbles in the water move from the freezing part of the water to the pre-freezing part of the water. As described above, in case where the first tray 111 and the second tray 112 are configured to be arranged in a side-to-side (left and right) orientation so that at least one of them is coupled or uncoupled while moving in the horizontal direction, the second heater 152 may be located in the fixed tray. Therefore, the part of the ice-making container 110 adjacent to the second heater 152, i.e., the fixed tray, is the last to freeze, and some of the air bubbles not expelled to the outside may cause a locally opaque part in the icing, but transparent ice may be generated as a whole.

When the second heater 940 operates, the control unit 910 may perform a variable control of the second heater 940 (S1005). The second heater 940 may be operated for a preset period of time in a predetermined ice-making mode, and the ice-making process may be variably controlled by the control unit 910. The variable control operation of the second heater 940 according to an embodiment of the disclosure will be described below with reference to FIG. 11.

Then, it is determined whether the variable control of the second heater 940 is completed (S1007).

When the variable control of the second heater 940 is completed, the operation of the second heater 940 is terminated, and additional ice-making is performed (S1009).

Subsequently, it is determined whether additional ice-making complete condition is satisfied (S1011). The additional ice-making complete condition may be set based on whether the temperature of the ice-making container 110 is maintained for a certain amount of time after reaching a predetermined temperature, or whether a predetermined amount of time has elapsed after a start of additional ice-making (i.e., after the operation of the second heater 940 is terminated). For example, the predetermined temperature may be set to −12° C. to −14° C., and when that temperature or range of temperatures is maintained for at least five minutes, it may be determined to satisfy the additional ice-making complete condition. Alternatively, when the predetermined time set to 30 minutes and that time has elapsed, it may be determined that the additional ice-making complete condition is satisfied. Alternatively, when the longer of the predetermined time and the time taken to reach the predetermined temperature has lapsed, it may be determined that the additional ice-making complete condition is satisfied.

When the additional ice-making complete condition is satisfied, the control unit 910 operates at least one of the first heater 930 or the second heater 940 (S1013). Operating at least one of the first heater 930 or the second heater 940 is intended to facilitate discharge of the ice from the ice-making container 110.

Subsequently, it is determined whether an ice-separating condition is satisfied (S1015). The ice-separating condition may be established based on whether the temperature of the ice-making container 110 has reached a predetermined temperature, or may be established based on whether a predetermined time has elapsed after operating at least one of the first heater 930 or the second heater 940. Alternatively, it may be determined that the ice-separating condition is satisfied, when the shorter of the predetermined time and the time taken to reach the predetermined temperature has lapsed. For example, the predetermined temperature may be set to −6° C. to −8° C., and the predetermined time may be set to 15 minutes.

When the ice-separating condition is satisfied, the coupling of the first tray 111 and the second tray 112 making up the ice-making container 110 is released (S1017). By uncoupling the first tray 111 and the second tray 112, the ice generated in the chamber of the ice-making container 110 may be moved to a storage container. Such uncoupling of the first tray 111 and the second tray 112 may be performed by the control unit 910 driving the driving unit 920, and the driving unit 920 may cause at least one of the first tray 111 or the second tray 112 to be moved so that the coupling is released. The first tray 111 and the second tray 112 may be uncoupled after terminating operation of the first heater 930 and the second heater 940, which are in operation under the control of the control unit 910. It is also possible to uncouple the first tray 111 and the second tray 112 without terminating the operation of the first heater 930 and the second heater 940 being operated by the control unit 910, and the control operation of the first heater 930 and the second heater 940 while ice-separating according to another embodiment of the disclosure will be described later with reference to FIG. 12.

After the first tray 111 and the second tray 112 are uncoupled, it is determined whether the ice-separating is completed (S1019). Determining whether the ice-separating is completed may be made by a separate sensor, such as, for example, a photo-sensor disposed adjacent to the ice-making container 110, a pressure sensor disposed in the storage container or the like. Alternatively, when the first tray 111 and the second tray 112 are uncoupled and spaced apart by a predetermined distance from each other, it may be determined that the ice-separating has been completed, or when a predetermined time elapses after the first tray 111 and the second tray 112 are uncoupled, it may be determined that the ice-separating has been completed.

When it is determined that the ice-separating has been completed, the first tray 111 and the second tray 112 are coupled together (S1021). Then, at least one of the first heater 930 or the second heater 940 is operated by the control unit 910 (S1023). This is to remove residual ice from the sealing surface or the water supply guide 130. At this time, at least one of the first heater 930 or the second heater 940 may operate substantially at 100% duty.

In an embodiment, operation of the first heater 930 or the second heater 940 after the ice-making is completed may be determined by an ice-making mode. The ice-making mode may be set to any one of a first mode for producing transparent ice (e.g., a transparent mode), a second mode for producing normal ice (e.g., a normal mode), and a third mode for producing ice at a high speed (e.g., a fast icing mode), wherein the operation of the first heater 930 or the second heater 940 after the ice-making is completed may be determined according to the ice-making mode. For example, the first heater 930 may be operated when the ice-making mode is the transparent mode. Further, when the ice-making mode is the normal mode, at least one of the first heater 930 or the second heater 940 may be operated. Furthermore, when the ice-making mode is the fast icing mode, the first heater 930 and the second heater 940 may be operated simultaneously. Depending on the ice-making mode, energy may be utilized more efficiently by selectively operating the first heater 930 or the second heater 940 after the ice-making is completed.

In another embodiment, operation of the first heater 930 or the second heater 940 after the ice-separating is completed may be determined by an additional icing complete condition. As described above, the additional ice-making complete condition may be set based on whether the temperature of the ice-making container 110 is maintained for a certain amount of time after reaching a predetermined temperature, or whether a predetermined amount of time has elapsed after the start of additional ice-making (i.e., after operation of the second heater 940 has ended). For example, when as the additional ice-making complete condition, the temperature reaches a predetermined temperature and is maintained for a certain period of time, both the first heater 930 and the second heater 940 may operate. Alternatively, when as the additional ice-making complete condition, the temperature has not reached the predetermined temperature but a certain period of time has elapsed, only the second heater 940 may operate. Energy can be used more efficiently by selectively operating either the first heater 930 or the second heater 940 after the ice-separating is complete, depending on the additional ice-making complete condition.

It is then determined whether the residual ice removal complete condition is satisfied (S1025). The residual ice removal complete condition may be set based on whether the temperature of the ice-making container 110 has reached a predetermined temperature, or may be set based on whether a predetermined time has elapsed after operating at least one of the first heater 930 or the second heater 940. Alternatively, it may be determined that the ice removal complete condition is satisfied, when the predetermined time or the time taken to reach the predetermined temperature, whichever is shorter, has elapsed. For example, the predetermined temperature may be set to 25° C. to 30° C., and the predetermined time may be set to 1 hour.

When the residual ice removal complete condition is satisfied, the operation of the at least one of the first heater 930 and the second heater 940 being operated by the control unit 910 is terminated (S1027). In an embodiment, when both the first heater 930 and the second heater 940 are operating for removing the residual ice, the operation of the first heater 930 and the second heater 940 may be terminated sequentially. The condition for sequentially terminating the operation of the first heater 930 and the second heater 940 may be set either based on whether the temperature of the ice-making container 110 reaches a predetermined temperature, or based on whether a predetermined time has elapsed after the first heater 930 or the second heater 940 was operated. For example, in case where the temperature of the ice-making container 110 reaches a first predetermined temperature (such as 15° C.), the operation of the first heater 930 may be terminated first, and in case where the temperature of the ice-making container 110 continues to rise and reaches a second predetermined temperature (such as 27° C.), the operation of the second heater 940 may be then terminated. Further, when a first predetermined time (e.g., 45 minutes) has elapsed after the first heater 930 was operated, the operation of the first heater 930 may be terminated first, and when a second predetermined time (e.g., 60 minutes) has elapsed after the second heater 940 was operated, the operation of the second heater 940 may be then terminated.

Thereafter, the water supplying to the chamber of the ice-making container 110 may be initiated to restart an ice-making cycle. Accordingly, it is possible for every ice-making cycle to remove residual ice remaining in the sealing portion or the water supply guide after ice-separating.

Figure 11:
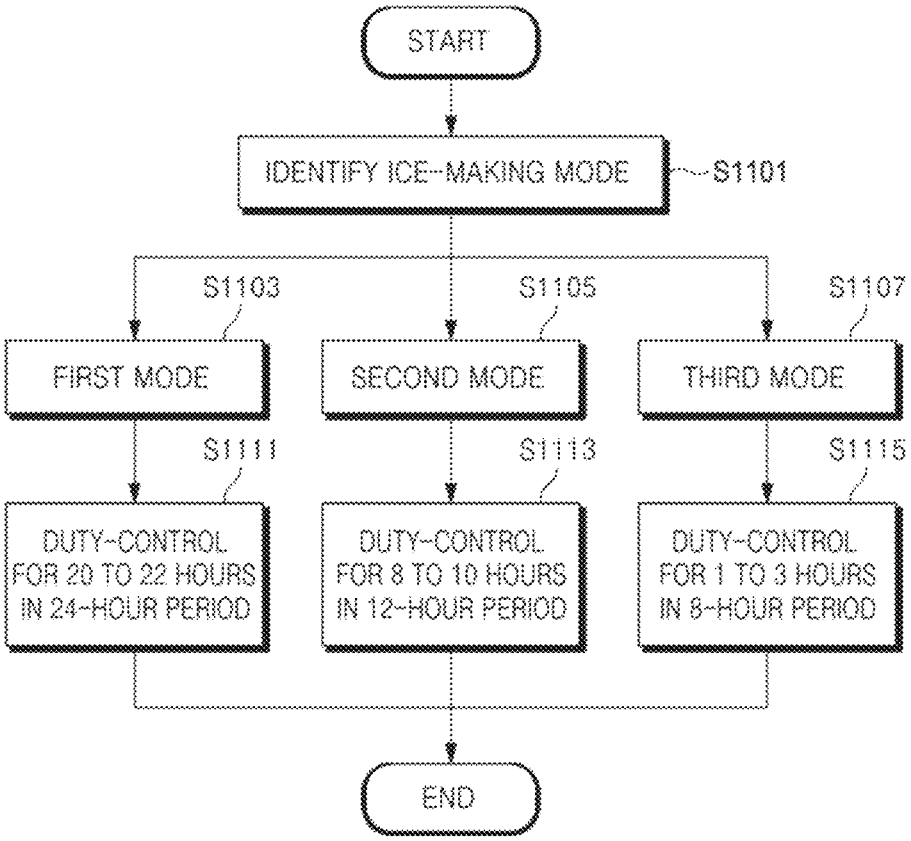
FIG. 11 is a flowchart to describe a variable control process of a heater according to an ice-making mode in an ice maker according to an embodiment of the disclosure.

FIG. 11 is a flowchart to illustrate a process of variable control of a heater according to an ice-making mode in an ice maker according to an embodiment of the disclosure.

Referring to FIG. 11, when an ice-making is initiated, the control unit 910 identifies an ice-making mode set by a user (S1101). The ice-making mode may be set to any one of a first mode for producing transparent ice, a second mode for producing regular ice, and a third mode for producing ice at high speed. The first mode may perform one icing cycle every 24 hours (i.e., one icing cycle per day), the second mode may perform one icing cycle every 12 hours (i.e., two icing cycles per day), and the third mode may perform one icing cycle every 8 hours (i.e., three icing cycles per day). The setting of ice-making mode may be established by the user for every ice-making cycle, or may be preset in advance.

When it is determined that the set mode is the first mode (S1103), the second heater 940 may be variably controlled (S1111) by the control unit 910 during one ice-making cycle performed for a 24-hour period. Specifically, the control unit 910 may duty-control the second heater 940 according to the temperature and the time measured over a period of about 20 to 22 hours.

When it is determined that the set mode is the second mode (S1105), the second heater 940 may be variably controlled (S1113) by the control unit 910 during one ice making cycle performed for a 12-hour period. Specifically, the control unit 910 may duty-control the second heater 940 according to the temperature and the time measured over a period of about 8 to 10 hours.

When it is determined that the set mode is the third mode (S1107), the second heater 940 may be variably controlled (S1115) by the control unit 910 during one ice-making cycle performed for an 8-hour period. Specifically, the control unit 910 may duty-control the second heater 940 according to the temperature and the time measured over a period of about 1 to 3 hours.

As described above, the second heater 940 may be variably controlled by the control unit 910 according to each ice-making mode to produce a desired degree of clearness at predetermined intervals.

Figure 12:
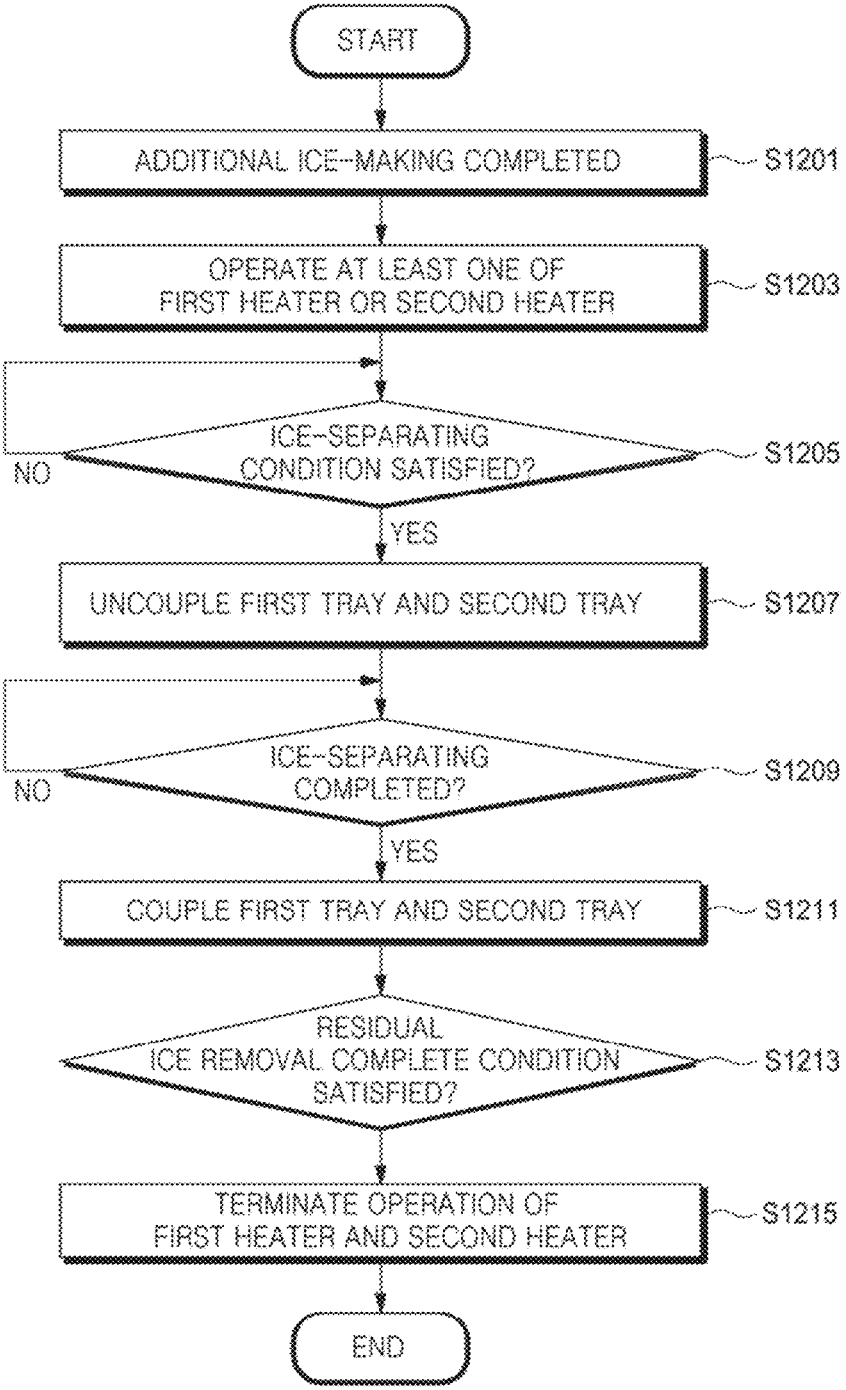
FIG. 12 is a flowchart to illustrate a control process of a first heater and a second heater upon ice-separating during an ice-making process in an ice maker according to an embodiment of the disclosure.

FIG. 12 is a flowchart to illustrate a control operation of a first heater and a second heater upon ice-separating during an ice-making process in an ice maker according to an embodiment of the disclosure.

Referring to FIG. 12, it is described the control operation of the first heater and the second heater in an ice-separating step after completion of an additional ice-making (S1201). When it is determined that the additional ice-making has been completed (S1201), at least one of the first heater 930 or the second heater 940 is operated (S1203) by the control unit 910.

Thereafter, it is determined whether an ice-separating condition is satisfied (S1205). If the ice-separating condition is satisfied, the first tray 111 and the second tray 112 making up the ice-making container 110 are uncoupled (S1207). By uncoupling the first tray 111 and the second tray 112, the ice generated in the chamber of the ice-making container 110 may be transferred to the storage container. When at least one of the first tray 111 or the second tray 112 is moved by the driving unit 920 to be uncoupled, the operation of the first heater 930 and the second heater 940 being operated by the control unit 910 is not terminated, that is to say, as the first heater 930 or the second heater 940 is operated, the coupling of the first tray 111 and the second tray 112 is released.

After the first tray 111 and the second tray 112 are uncoupled, it is determined whether the ice-separating has been completed (S1209). When it is determined that the ice-separating is completed, the first tray 111 and the second tray 112 are coupled (S1211). Then, it is determined whether a residual ice removal complete condition is satisfied (S1213). When the residual ice removal complete condition is satisfied, the operation of the first heater 930 and the second heater 940 being operated by the control unit 910 is terminated (S1215).

As described above, the ice-making cycle can be performed by controlling each component of the ice maker 100 under the control of the control unit 910. After ice-separating for every ice-making cycle, the ice maker 100 may operate at least one of the first heater 930 or the second heater 940 to effectively remove residual ice from the sealing surface between the first tray 111 and the second tray 112 or the water supply guide 130.

While one or more embodiments have been described in detail, they are provided only to help a more general understanding of the disclosure and are not intended to be limiting thereto, and those skilled in the art may make various changes and modifications from this description. Accordingly, the disclosure should not be limited to the embodiments described above, and the following claims, as well as all equivalents or modifications thereof, are intended to fall within the scope of the concepts of the disclosure.

What is claimed is:

1. An ice maker comprising:

an ice-making container comprising a first tray and a second tray coupled to each other at a sealing surface between the first tray and the second tray, wherein the first tray comprises a first tray body, the first tray body comprising a protrusion that protrudes along the sealing surface toward the second tray;

a water supply guide comprising a first end connected to the ice-making container, the water supply guide being configured to supply water to the ice-making container;

a first heater provided adjacent to or in the ice-making container; and a second heater provided adjacent to or in the ice-making container and at a position that is different than a position of the first heater, wherein the first heater is closer to the sealing surface than the second heater.

2. The ice maker of claim 1, wherein at least a portion of the first heater is provided along the sealing surface.

3. The ice maker of claim 1, wherein at least a portion of the first heater extends from the first end of the water supply guide to a second end of the water supply guide.

4. The ice maker of claim 1, further comprising a housing in which the ice-making container and the water supply guide are accommodated, wherein housing has an opening through which the water supply guide is installed, and wherein at least a portion of the first heater is provided along the opening.

5. The ice maker of claim 1, further comprising:

a controller configured to control operation of the first heater and the second heater; and a driver configured to couple and uncouple the first tray and the second tray;

wherein the controller is further configured to:

control the driver to uncouple the first tray and the second tray to cause ice to discharge from the ice-making container, and to couple the first tray and the second tray; and based on the coupling of the first tray and the second tray, control the first heater or the second heater to operate.

6. The ice maker of claim 1, further comprising:

a driver configured to couple and uncouple the first tray and the second tray; and a controller configured to:

control the driver to uncouple the first tray and the second tray to discharge ice from the ice-making container, and to couple the first tray and the second tray; and based on the coupling of the first tray and the second tray, control at least one of the first heater or the second heater to operate.

7. The ice maker of claim 6, wherein the controller is further configured to, based on a temperature of the ice-making container reaching a first predetermined temperature or a first predetermined time elapsing, terminate the operation of at least one of the first heater and the second heater.

8. The ice maker of claim 1, wherein the second tray comprises a second tray body, the second tray body comprising an insertion recess configured to receive the protrusion along the sealing surface, and wherein one of the first tray body or the second tray body comprises a first rib that protrudes along the sealing surface toward the other one of the first tray or the second tray, and the first rib is configured to deform upon application of pressure.

9. The ice maker of claim 1, wherein the first tray further comprises a first tray casing enclosing the first tray body, wherein the second tray further comprises a second tray casing enclosing a second tray body, and wherein the first tray body further comprises a second rib that protrudes toward the second tray casing and is configured deform under pressure by the second tray casing, or the second tray body further comprises a second rib that protrudes toward the first tray casing and is configured deform under pressure by the first tray casing.

10. The ice maker of claim 1, wherein the first tray and the second tray are disposed in a side-to-side orientation and are configured to be coupled or uncoupled by the first tray and the second tray moving in a horizontal direction.

11. A method of controlling an ice maker, the method comprising:

controlling a driver connected to at least one of a first tray or a second tray of the ice maker to release coupling of the first tray and the second tray, so that ice is discharged from an ice-making container of the ice maker in which the first tray and the second tray are coupled;

controlling the driver to couple the first tray and the second tray together; and operating, based on the coupling of the first tray and the second tray, a first heater of the ice maker provided adjacent to a sealing surface at which the first tray and the second tray are coupled or provided adjacent to a water supply guide, wherein the first tray comprises a first tray body, the first tray body comprising a protrusion that protrudes along the sealing surface toward the second tray.

12. The method of claim 11, further comprising:

based on the coupling, controlling the first heater to operate; and based on a temperature of the ice-making container reaching a first predetermined temperature or a first predetermined time elapsing, controlling to terminate the operation of the first heater.

13. The method of claim 12, further comprising controlling the first heater to cease operation, and supplying water to the ice-making container via the water supply guide.

14. The method of claim 11, further comprising, based on the coupling of the first heater and a second heater, controlling the second heater of the ice maker that is provided within or adjacent to the first tray and at a position different from a position of the first heater.

15. The method of claim 14, further comprising, based on the coupling of the first tray and the second tray, performing operating the first heater and the second heater, and supplying water to the ice-making container via the water supply guide.

16. An apparatus comprising:

a container comprising a first tray and a second tray coupled to each other at a sealing surface between the first tray and the second tray, wherein the first tray comprises a first tray body, the first tray body comprising a protrusion that protrudes along the sealing surface toward the second tray;

a water supply guide comprising a first end connected to the container, the water supply guide being configured to supply water to the container;

a first heater adjacent to or in the container; and a second heater adjacent to or in the container, and at a position that is different than a position of the first heater, wherein the first heater is closer to the sealing surface than the second heater.

17. The apparatus of claim 16, wherein at least a portion of the first heater is provided along the sealing surface.

18. The apparatus of claim 16, wherein at least a portion of the first heater extends from the first end of the water supply guide to a second end of the water supply guide.

19. The apparatus of claim 16, further comprising a housing configured to receive the container and the water supply guide, wherein the housing has an opening through which the water supply guide is installed, and wherein at least a portion of the first heater is provided along the opening.

20. The apparatus of claim 16, further comprising:

a driver configured to couple and uncouple the first tray and the second tray;

a controller configured to:

control the driver to uncouple the first tray and the second tray to cause ice to discharge from the container, and to couple the first tray and the second tray; and based on the coupling of the first tray and the second tray, control at least one of the first heater or the second heater to operate.

* * * * *